United States Patent [19]

Yamamoto et al.

[11] Patent Number: 4,696,100

[45] Date of Patent: Sep. 29, 1987

[54] METHOD OF MANUFACTURING A CHIP COIL

[75] Inventors: Hiromasa Yamamoto, Toyonaka; Sankichi Shida, Nara; Tsunehiko Todoroki, Kusatsu, all of Japan

[73] Assignee: Matsushita Electric Industrial Co., Ltd., Kadoma, Japan

[21] Appl. No.: 882,567

[22] Filed: Jun. 30, 1986

Related U.S. Application Data

[60] Division of Ser. No. 704,136, Feb. 21, 1985, abandoned, which is a continuation of Ser. No. 418,173, Sep. 14, 1982, abandoned.

[51] Int. Cl.[4] ..... H01F 41/00

[52] U.S. Cl. ..... 29/605; 29/606; 29/608; 336/83; 336/192; 336/233

[58] Field of Search ..... 336/65, 83, 96, 205, 336/221, 222, 177, 192, 233; 29/605 R, 606, 608

[56] References Cited

U.S. PATENT DOCUMENTS

| | | | |
|---|---|---|---|
| 3,183,466 | 5/1965 | Martus | 336/96 X |
| 3,711,805 | 1/1973 | Heijnen et al. | 336/65 |
| 3,743,990 | 7/1973 | Renskers et al. | 336/65 X |
| 4,109,223 | 8/1978 | Tenkman et al. | 336/96 X |
| 4,400,674 | 8/1983 | Suda et al. | 336/65 |

OTHER PUBLICATIONS

Japanese Patent Application No. 55-91804, published Jul. 11, 1980.

Japanese Patent Application No. 55-91103, published Jul. 10, 1984.

*Primary Examiner*—Carl E. Hall

*Attorney, Agent, or Firm*—Wenderoth, Lind & Ponack

[57] ABSTRACT

A method of manufacturing a chip coil, including a coil element which includes a magnetic core, a winding wire, and internal terminal electrodes, a fired mass of magnetic material surrounding and encapsulating the coil element, and external terminal electrodes electrically connected to the internal terminal electrodes. The winding wire is coated with a heat-resistive electrically insulating film and is wound around the magnetic core. The internal terminal electrodes are electrically connected to opposite ends of the winding wire and are exposed to the exterior of the mass at opposite ends of the core where they are electrically connected to the external terminal electrodes.

5 Claims, 10 Drawing Figures

METHOD OF MANUFACTURING A CHIP COIL

This application is a divisional application of now abandoned application Ser. No. 704,136, filed Feb. 21, 1985, which is a continuation of now abandoned application Ser. No. 418,173, filed Sept. 14, 1982.

BACKGROUND OF THE INVENTION

This invention relates to a coil used for electric circuits or the like, and more particularly to a method of manufacturing semiconductor chip coil which is capable of being face-banded onto a printed substrate.

DESCRIPTION OF THE PRIOR ART

Recently, various electronic parts have been miniaturized and formed in semiconductor chips because printed circuit substrates have become small-sized and mounted in high density. Similarly, coils have been formed on chips in various ways. Typical examples of the conventional chip coils are shown in Japanese Utility Model Publications Nos. Sho 54-7320, Sho 52-78749 and Sho 52-78750. The conventional chip coil comprises a winding wire having a resin film and wound around a magnetic core, the wire connecting at both ends to terminal electrodes exposed to the exterior respectively, the coil being coated circumferentially with resin including a magnetic substance, which is the so-called wire-wound type chip coil. This wire-wound type chip coil is charaterized by being manufactured simply by using conventional manufacturing facilities and techniques. However, in order to protect the resin film at the winding from heat during the face-bonding such as solder-dipping or solder-reflowing, the outer resin layer should be thick, and therefore large in the size. If the coil is small-sized, trouble of short circuiting will be caused in the winding unless temperature and the time period of heating are controlled carefully and accurately. Further, the coil, even when coated with resin including the magnetic substance, is essentially formed in an open magnetic circuit and therefore defective in that the coil, when mounted on the printed circuit substrate, affects other coils.

SUMMARY OF THE INVENTION

An object of the invention is to provide a method of manufacturing a chip coil free from the conventional defects, which is small-sized, sufficiently able to withstand the heat generated during face-bonding carried out as by solder dipping or solder reflowing, having a closed magnetic circuit, and capable of being mounted on the printed circuit substrate without affecting other coils.

Briefly, the chip coil manufactured in accordance with the invention is so constructed that a coil element comprises a magnetic core, a wire wound around the magnetic core and coated with a heat-resistive insulating film, and first and second internal terminal electrodes provided at both ends of the magnetic core and connected to the respective ends of the winding wire, the coil element being armored encapsulated circumferentially by a magnetic substance through which the first and second internal terminal electrodes are exposed, and first and second external terminal electrodes connecting electrically with the first and second internal terminal electrodes are provided at both ends of the magnetic substance.

Also briefly, the method of manufacture of the chip coil, of the invention comprises the steps of: forming a coil element in such a manner that a winding wire covered with a heat-resistive insulating film is wound around the magnetic core and first and second internal terminal electrodes connecting with both terminals of the winding wire are provided at both ends of the magnetic core; encapsulating the coil element in a magnetic substance; exposing the first and second internal terminal electrodes to the exterior of the magnetic substance after firing the same; and then providing at both ends of the fired magnetic substance first and second external terminal electrodes connecting with the first and second exposed internal terminal electrodes, respectively.

The above and other objects of the invention will become more apparent in the following detailed description and examples taken with the accompanying drawings.

BRIEF DESCRIPTION OF THE DRAWINGS

Incidentally, in the drawings the same components are designed by the same reference numerals.

DETAILED DESCRIPTION OF THE INVENTION

The chip coil manufactured by the method of the invention and the method of manufacture thereof will be detailed on the basis of an embodiment thereof.

Figure 1:
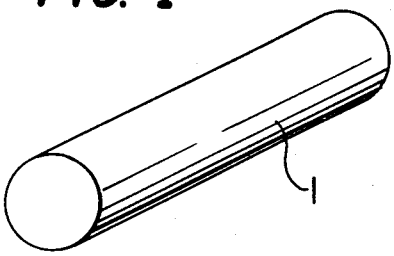
FIG. 1 is a perspective view exemplary of a magnetic core around which a winding wire is wound.

Referring to FIG. 1, a magnetic core 1, around which a winding wire is wound, is produced by extruding paste of a magnetic substance into a rod and then the paste is fired. The columnar core 1 in FIG. 1 may alternatively have another shape such as polygonal-pillar.

Figure 2:
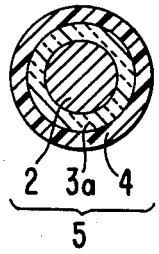
FIG. 2 is a sectional view of a winding wire using a magnetic substance as a heat-restrictive insulating film.

FIG. 2 shows a first example of a winding wire 5 in section, which comprises a conductive wire 2 and a magnetic substance film 3*a* as a heat resistive electrically insulating film and a resin film 4, around the wire 2. Prior to winding wire 5, the magnetic substance film 3*a* is not fired and is therefore covered by the resin film 4 so as to be prevented from being frictionally peeled off when the wire 5 is wound.

Figure 3:
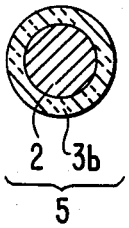
FIG. 3 is a sectional view of a winding wire using glass as the heat-restrictive insulating film.

A second example of the winding wire 5, as shown in FIG. 3, comprises a conductive wire 2 coated by a glass film 3*b* as the heat-resistive electrically insulating film, the glass, when sufficiently thin, being flexible and mechanically strong enough to permit the wire to be wound, thus permitting the resin film 4 to be omitted.

Such a heat-resistive insulating film should withstand the firing temperature for the magnetic substance in use and ensure the desired electrical insulation, the magnetic substance film 3*a* and glass film 3*b* both satisfying the above requirement.

The conductive wire 2 employs a metal, such as silver. The metal may be an alloy of silver and palladium such as silver, palladium and platinum, copper and silver or copper, zinc and silver. These alloys are not promoted to oxidize and not fused at the firing temperature for the magnetic substance. Out of these alloys, the alloy of silver and palladium is preferable for performance and economy.

The conductive wire 2 is preferred to be about 50 μm in diameter for usual use, and the outer film or films are preferably a total of 7 to 15 mm in thickness. The film, if larger in thickness than the above, will increase the winding wire 5 in its outer diameter, thereby being disadvantageous from the viewpoint of space, while the film, if smaller in thickness, will occasionally not adequately perform its function.

Figure 4:
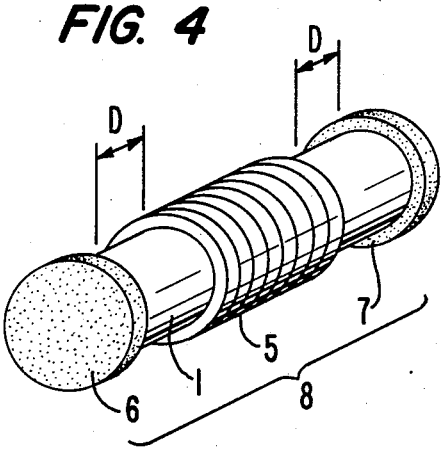
FIG. 4 is a perspective view of a coil element comprising the magnetic core, a winding wire, and first and second internal terminal electrodes.

The winding wire 5 is wound around the magnetic core 1 and adhered at the respective ends to both ends of magnetic core 1 through the first and second internal terminal electrodes 6 and 7 to thereby obtain a coil element 8 as shown in FIG. 4, the first and second internal terminal electrodes 6 and 7 being formed of conductive paste which has been dipped and dried or fired. In order that no oxidation is promoted at the firing temperature, a paste of the alloy of silver and palladium is preferred to be used. In addition, the conductive wire 2 of winding wire 5 is exposed at its ends for good connection with the first and second internal terminal electrodes 6 and 7.

In FIG. 4, the beginning and end of winding wire 5 are preferably separated from the first and second internal terminal electrodes 6 and 7 at respective intervals D of 0.5 mm or more. The interval D, if less than 0.5 mm, will lower the accuracy of inductance during the manufacturing, or may create cracks in the magnetic substance during the firing as is discussed in greater detail below.

Figure 5:
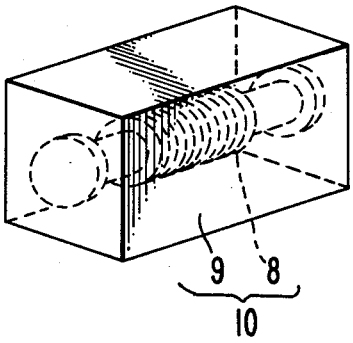
FIG. 5 is a perspective view of a molded body comprising a coil element encapsulated in a magnetic substance.

The coil element 8, as shown in FIG. 5, is surrounded by (encapsulated in) the mass of magnetic substance to form a molded body 10, which is in the shape of a quadrangular pilar, but may be columnar.

Also, the coil element 8 can be encapsulated in the magnetic substance by coating a magnetic substance paste around the coil element 8, or by pouring the magnetic substance paste into a mold encasing therein the coil element 8. However it is preferable to bury the coil element 8 in a quantity powder of the magnetic substance and apply pressure to the powder. This latter technique is more desirable because the powder under pressure is high in density and, after the firing (sintering) to be discussed below, is harder than the fired magnetic material paste. In either case, the coil element is surrounded by the magnetic substance 9 so that the latter is in intimate contact with the outer surface of winding wire 5.

It is most preferable that the molded body 10 be formed to allow the first and second internal terminal electrodes 6 and 7 to be exposed. The structure of coil element 8, however, is such that it is extremely difficult to expose the first and second internal terminal electrodes 6 and 7 from the mass of magnetic substance 9 by the above method of burying the coil element 8 in the powder of magnetic substance and applying pressure. From the aspect of mass production, the first and second internal terminal electrodes 6 and 7 are inevitably encapsulated in the magnetic substance. Hence, a polishing process to be discussed below is necessary to exposure of first and second internal terminal electrodes 6 and 7, thereby making as thin as possible the mass of magnetic substance in the vicinity of first and second internal terminal electrodes 6 and 7 for easy polishing.

Figure 6:
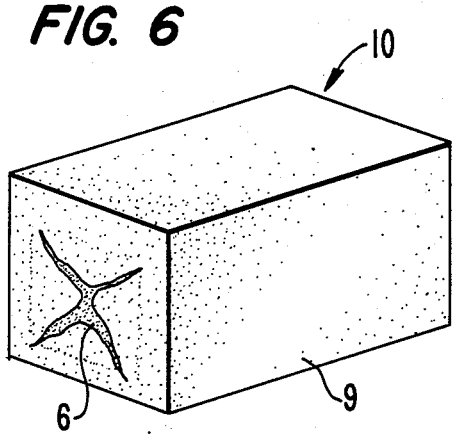
FIG. 6 is a perspective view of the molded body after fired.

The molded body 10 is fired to form a fired body as shown in FIG. 6, in which a crack is created in the magnetic substance mass 9 in the vicinity of the first internal terminal electrode 6, which is partially exposed as shown. The second internal terminal electrode 7, not shown, also is partially exposed. The cracks created as above facilitate polishing for exposing the first and second internal terminal electrodes 6 and 7.

Here, explanation will be given on a relation between the firing of the magnetic core 1 during the production thereof and that of molded body 10.

If the magnetic core 1 and magnetic substance mass 9 are of the same composition, the magnetic core 1, if sintered excessively during the firing thereof, shrinks insubstantially during the firing of molded body 10 although the magnetic substance mass 9 does shrink. As a result, the magnetic substance mass 9 will often be cracked.

In contrast, when the magnetic core 1 is not so sintered during the firing, the magnetic substance mass 9 and magnetic core 1, during the firing of the molded body 10, shrink to an equal extent. As a result, cracks are not created, or created to a lesser extent, in the vicinity of the first and second internal electric terminal electrodes 6 and 7, whereby it is troublesome to expose the first and second internal terminal electrodes 6 and 7 by the polishing technique to be discussed below. Therefore, the relationship between the magnetic core 1 and magnetic substance mass 9 in regard to shrinkage percentage is important during the firing of molded body 10.

Figure 7:
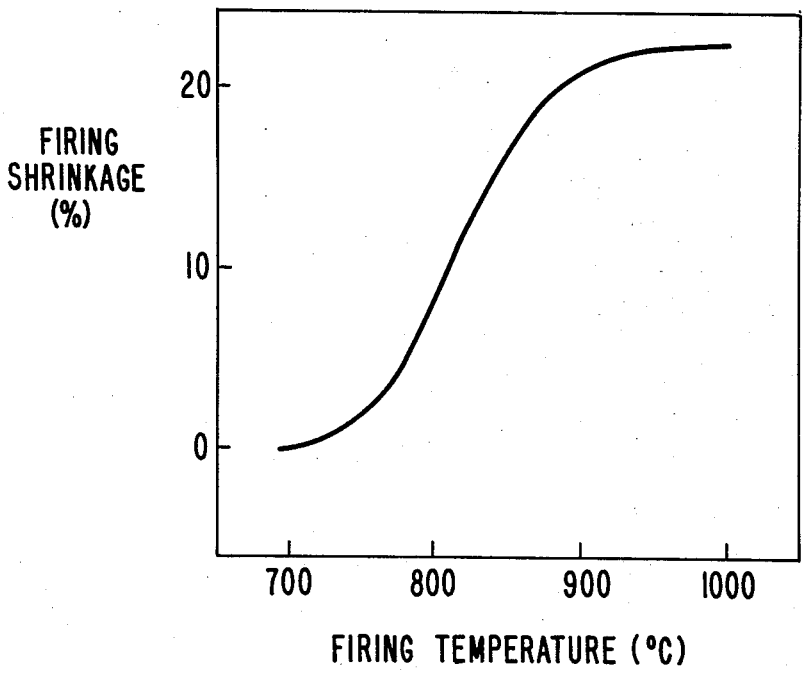
FIG. 7 is a graph representing a relation between the percentage of shrinkage and the firing temperature of ferrite composed mainly of $Fe_2O_3$, NiO, and ZnO.

Regarding the above, concrete explanation will further be given concerning the use of ferrite composed mainly of $Fe_2O_3$, NiO, and ZnO as the magnetic substance for magnetic core 1 and mass 9 where the firing temperature for ferrite is used to adjust the percentage of shrinkage. FIG. 7 shows a relation between the ferrite firing temperature and its percentage of shrinkage. The ferrite is held for 2 hours at each firing temperature. As seen from FIG. 7, the ferrite starts sintering at a temperature of 700° C. or more and the percentage of shrinkage is about constant at a firing temperature of 900° C. or more. For example, if the ferrite is sintered at 800° C. and then fired at 900° C., the shrinkage percentage of ferrite after fired at 900° C. is almost equal to that of ferrite fired at 900° C. from the start.

Table 1 below shows a relation between the firing temperature of magnetic core 1 and the percentage of times cracks were created in magnetic substance mass 9, from which it is seen that the firing temperature for magnetic core 1 is preferable selected in the range 800° to 880° C., particularly at about 850° C. In this case, a difference in the percentages of shrinkage of magnetic core 1 and magnetic substance mass 9 is 2 to 13% at 800° to 880° C. and about 5% at 850° C.

TABLE 1

| Firing Temperature of Magnetic Core (°C.) | 900 | 880 | 850 | 800 |
|---|---|---|---|---|
| Crack Creation Percentage at Magnetic Substance Armor | 80 | 20 | 0 | 0 |

The first and second internal terminal electrodes 6 and 7 may be exposed by polishing the fired molded body with sandpaper as usual. However, barrel-polishing is the most suitable for mass production, in which a number of fired molded bodies are encased within a rotating pot. The fired molded bodies 10, which each crack in the vicinity of first and second internal terminal electrodes 6 and 7 as shown in FIG. 6, are rubbed with each other as the pot rotates, so that the first and second internal terminal electrodes 6 and 7 are exposed. In addition, hard stones, such as agate, are put into the pot, thereby saving the time period for polishing.

Figure 8:
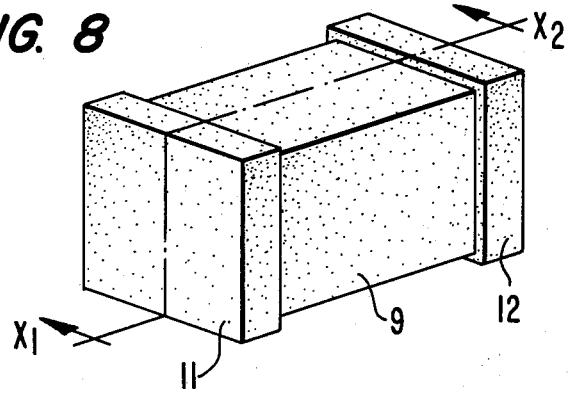
FIG. 8 is a perspective view of a chip coil manufactured in accordance with the method of the invention.

Finally, first and second external electrodes 11 and 12 for connection to a circuit of a printed substrate are attached to the fired molded body 10 as shown in FIG. 8, thus completing the chip coil of the invention. The first and second external terminal electrodes 11 and 12 are formed of conductive paste which is dipped at both ends of the fired molded body 10, at which the first and second internal terminal electrodes 6 and 7 are exposed and then the paste is dried or fired, the conductive paste being preferably an alloy of silver and paradium. In addition, the first and second external terminal electrodes 11 and 12 which have been formed of conductive paste are applied with, for example, solder plating, thereby improving the electrical connection to the circuit substrate.

Figure 9:
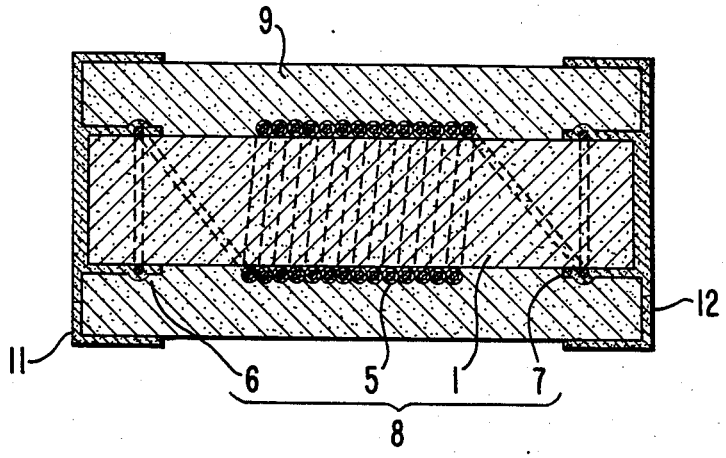
FIG. 9 is a sectional view taken on the line $X_1$–$X_2$ in FIG. 8.

FIG. 9 shows the chip coil manufactured by the method of the invention in longitudinal section, in which the wire 5 having the heat-resistive insulating film 3 (*3a* or *3b*) is wound around the magnetic core 1, the winding wire 5 connecting at its respective ends with the first and second internal terminal electrodes 6 and 7 provided at the ends of magnetic core 1. The coil element 8 comprises the magnetic core 1, winding wire 5, and first and second internal terminal electrodes 6 and 7, and is provided with the mass 9 from which the internal terminal electrode 6 and 7 are exposed, the internal terminal electrodes 6 and 7 connecting to the first and second external terminal electrodes 11 and 12 provided at the respective ends of magnetic substance mass 9.

When the magnetic substance film *3a* is used for the heat-resistive insulating film 3, the resin film 4 is further required to cover the film 3 as mentioned above. The resin film, however, becomes gaseous during the firing and exhausts almost completely from the chip coil, whereby the heat-resistive insulating film 3 and magnetic substance mass 9 are integral with each other after the molded body 10 is fired, so as to provide a very effective magnetic path.

In the case that the glass film *3b* is used for the heat-resistive insulating film 3, magnetic gaps remain, which is disadvantageous for the chip coil. However, the gaps, if the electrical resistance of magnetic core 1 or magnetic substance mass 9 is small, are effective in ensuring adequate electrical insulation between winding wires 5.

Figure 10:
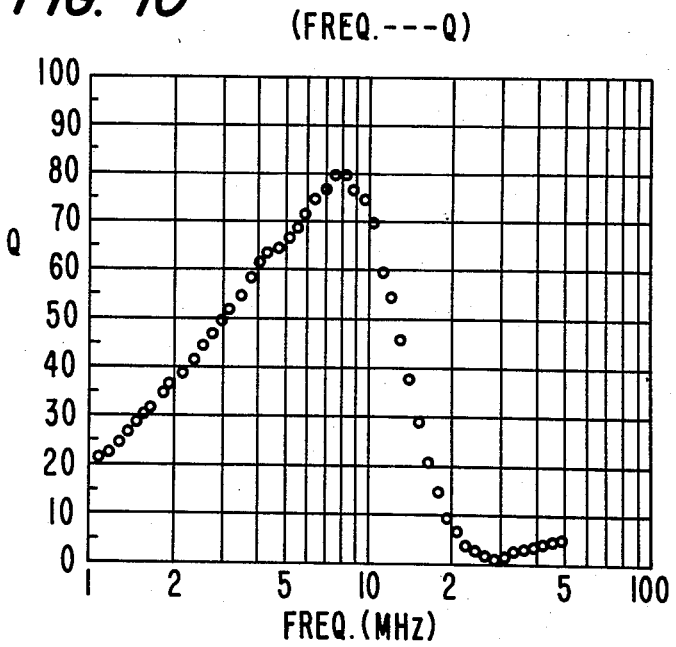
FIG. 10 is a graph representing an example of the frequency-Q characteristic of a chip coil manufactured in accordance with the method of the invention.

An exemplary characteristic of the chip coil of the invention is shown in FIG. 10, which shows the relation between the frequency and the Q characteristics of a chip coil of inductance of 30 $\mu$H in which the maximum value of Q is obtained at a Q value of about 80.

As seen from the above, the present invention is method of manufacturing a chip coil having a closed magnetic circuit. Also, chip coils manufactured by the method of the invention can be mounted in high density onto a printed circuit substrate through face-bonding by use of the dipping and reflowing process.

Although several embodiments have been described, they are merely exemplary of the invention and not to be construed as limiting, the invention being defined solely by the appended claims.

What is claimed is:

1. A method of manufacturing a chip coil comprising the steps of:

winding a conductor wire coated with a heat-resistive insulating film around a magnetic core, and connecting first and second internal terminal electrodes to respective opposite ends of the conductor wire, thereby to produce a coil element;

surrounding the coil element with a protective coating of magnetic substance powder;

after said step of surrounding, firing the coil element and coating of magnetic substance powder to obtain a single sintered mass of magnetic substance completely embedding therein the coil element without any gaps between the coil element and the single sintered mass so as to cover the conductor wire with the mass of magnetic substance in intimate contact with the entire outer surface of the conductor wire;

exposing at least part of each of the first and second internal terminal electrodes; and connecting first and second external terminal electrodes respectively with the first and second internal terminal electrodes at the exposed part thereof, thereby obtaining the chip coil.

2. The method according to claim 1, wherein said step of winding includes the step of winding around the magnetic core the conductor wire coated with a film of magnetic substance as the heat-resistive insulating film and further coated with a resin film on the film of magnetic substance.

3. The method according to claim 1, wherein the step of winding includes the step of winding around the magnetic core the conductor wire coated with a glass film as the heat-resistive insulating film.

4. The method according to claim 1, wherein said step of surrounding comprises the steps of embedding the coil element in a magnetic substance powder, and applying pressure to the magnetic substance powder.

5. The method according to claim 1, wherein said step of exposing ends of the first and second internal terminal electrodes comprises the step of polishing both ends of the single sintered mass of magnetic substance by barrel-polishing until the first and second internal terminal electrodes are at least partly exposed.

* * * * *